US012453908B2

(12) United States Patent
Fox

(10) Patent No.: US 12,453,908 B2
(45) Date of Patent: Oct. 28, 2025

(54) SYSTEM AND METHOD FOR GOLF TRAINING AID FOR PROPER HEAD POSITIONING THROUGHOUT THE USER'S SWING

(71) Applicant: Adroit Sports LLC, St. Louis, MO (US)

(72) Inventor: Carl W. Fox, St. Louis, MO (US)

(73) Assignee: Adroit Sports LLC, St. Louis, MO (US)

( * ) Notice: Subject to any disclaimer, the term of this patent is extended or adjusted under 35 U.S.C. 154(b) by 0 days.

(21) Appl. No.: 18/954,819

(22) Filed: Nov. 21, 2024

(65) Prior Publication Data

US 2025/0073542 A1 Mar. 6, 2025

(51) Int. Cl.
*A63B 69/36* (2006.01)
*A63B 53/04* (2015.01)

(52) U.S. Cl.
CPC ..... *A63B 53/0441* (2020.08); *A63B 69/3632* (2013.01)

(58) Field of Classification Search
CPC ..... A63B 53/0441; A63B 69/3632
USPC ..... 473/219–226, 242–254, 330–331, 409
See application file for complete search history.

(56) References Cited

U.S. PATENT DOCUMENTS 5,288,080 A * 2/1994 Tice ..... A63B 69/3614 473/220
5,441,269 A * 8/1995 Henwood ..... A63B 69/3685 473/223
5,630,764 A * 5/1997 McNair ..... A63B 69/3632 473/220
5,692,964 A * 12/1997 Smith ..... A63B 69/3614 273/DIG. 30
5,919,098 A 7/1999 Salmon
6,736,735 B2 * 5/2004 Galanis ..... A63B 69/3614 473/221
9,079,074 B2 7/2015 Lindsey
9,566,478 B2 * 2/2017 Boyd ..... A63B 53/04
2004/0029707 A1 * 2/2004 Beall ..... F01N 3/022 264/631
2012/0046118 A1 * 2/2012 Nam ..... A63B 69/3614 473/220
2012/0115626 A1 * 5/2012 Davenport ..... A63B 69/3632 473/223

FOREIGN PATENT DOCUMENTS

DE 202009007328 U1 8/2009
GB 2110095 6/1983
WO WO-2005118086 A1 * 12/2005 ..... A63B 60/46

* cited by examiner

*Primary Examiner* — Nini F Legesse

(57) ABSTRACT

This system and method for a golf training aid encompasses a golf driver with a light-emitting diode (LED) embedded within the head of the golf driver. The LED is visible from an opening in the top of the golf driver head. The LED is removable and rechargeable. By focusing the user's eye contact with the LED until the point of contact with the golf ball, the golf training aid serves to prevent the user from bringing their head up at the point of contact with the ball, thereby addressing technique issues related to poor posture, poor contact, loss of power, early extension, increased pressure on the lower back, and inconsistent swings. The LED's emission of a plurality of light colors and flash patterns is user actuated and configured to adapt to the user's individual preferences and weather conditions during play.

10 Claims, 3 Drawing Sheets

SYSTEM AND METHOD FOR GOLF TRAINING AID FOR PROPER HEAD POSITIONING THROUGHOUT THE USER'S SWING

BACKGROUND

1. Field of the Invention

The present invention relates to a golf club as a golf training device.

2. Description of Related Art

Many training devices exist in the prior art which can be used during practice to help the user hit the golf ball effectively and accurately. Solutions are generally directed to allowing the user to play during different lighting conditions, focusing the user's gaze during high speed swings and at exact point of contact with the golf ball, measuring the amount of force required for an effective putt, and providing visual confirmation of the golf club head's path during a golf swing.

So as to reduce the complexity and length of the Detailed Specification, and to fully establish the state of the art in certain areas of technology, Applicant(s) herein expressly incorporate(s) by reference all of the following materials identified in each numbered paragraph below.

Patent number KR20080067757A is a golf driver with a battery-powered light-emitting diode (LED) lamp inserted into the head of the golf driver. The light emits from the head of the driver in response to a shock signal when the club strikes a golf ball. This LED lamp prevents the user from raising their head too quickly during the course of their swing.

Patent Number KR100624323B1 is a golf putter with LED Lamp designed to help users see at night and understand the amount of force needed to effectively putt. The invention describes a golf putter with a battery-operated LED light which is located at the top of the putter's head. It includes a striking portion, or face, which is composed of a responsive elastic material. A light shines when the putter makes connection with the golf ball. The greater force a user uses when making contact with the golf ball during her swing, the brighter the light shines.

Patent Number U.S. Pat. No. 9,079,074B2 is an athletic training device that enables athletes' observation of athletes to observe the collision between a ball sports devices, such as bats, clubs, or racquets.

Patent Number DE202009007328U1 is an external, attachable lamp bracket that emits light such that the user can follow the beam in bright conditions and at high swing speeds.

Patent Number GB2110095 is a practice golf club with a light emitting diode fitted to the head of the club to indicate the path followed by the club head as it is swung so users can visualize and understand the path their club head takes during a swing. This LED lamp allows users to make adjustments and improve their technique.

Patent Number JP2013094640 is a golf club with LED lights embedded within the head of the golf driver and along its shaft. The LED lights are evenly distributed along the shaft and also located at the center of the head, providing visual cues for timing and swing confirmation. The club also includes a switch that allows the user to control the blinking of the LED lights.

Patent Number JP2013085944 is a golf club with a small LED light positioned on the head of a golf driver. The use of a minimal LED light on a golf club head helps improve accuracy by providing visual feedback on the hitting position.

Patent Number JPH07313651 describes a device that can be attached to the head of a user's golf club and the base of the club shaft. It emits an LED to prevent a user's head from coming up during a swing.

Patent Number U.S. Pat. No. 5,919,098A is a lighting apparatus that can be mounted to a golf club. The device can be attached to the side of a golf club driver and emits a beam of light toward the user.

Applicant(s) believe(s) that the material incorporated above is "non-essential" in accordance with 37 CFR 1.57, because it is referred to for purposes of indicating the background of the invention or illustrating the state of the art. However, if the Examiner believes that any of the above-incorporated material constitutes "essential material" within the meaning of 37 CFR 1.57 (c) (1)-(3), Applicant(s) will amend the specification to expressly recite the essential material that is incorporated by reference as allowed by the applicable rules.

SUMMARY

In an aspect described herein, a golf driver swing aid is disclosed. The golf driver head may have an interior comprising a recessed cavity, which may be accessible from the top of the golf driver head. The recessed cavity may house a removable multi-color light-emitting diode (LED) which may be configured to emit a plurality of lighting patterns and colors and may be controlled by a user-actuated switch that is within the golf driver head and connected electrically and physically to removable multi-color LED. The switch may include light color and flash pattern configurations. The switch may be situated away from the inner wall of the recessed cavity and may partially cover a top of the removable multi-color LED. There may also be a rechargeable power source within the golf driver head that is coupled to the removable multi-color LED. The golf driver head may also have a receiver configured to transmit and receive wireless communication signal to and from a mobile device.

There may also be a cylindrical shaft within the golf driver head which is configured to receive and secure the golf driver shaft. There may also be a cover plate secured to the face of the golf driver head.

The recessed cavity may have a base that is situated away from golf driver head, forming a hollow chamber between the base of the recessed cavity and the lower wall of the golf driver head.

In a method described herein, a user may select a desired color emitted from a removable multi-color LED positioned within a recessed cavity in a head of a golf driver wherein the removable multi-color LED is configured to emit a multitude of lighting patterns. A user may align the golf driver behind a ball and swing the golf driver while maintaining eye contact with the removable multi-color LED until the golf driver head makes contact with the ball.

A user may engage the removable multi-color LED by actuating a switch integrated within the recessed cavity of the golf driver head that is electronically connected to the removable multi-color LED, which is configured to change at least one of a light color and light flash pattern. A user may transmit a wireless communication signal to a transceiver coupled with the removable multi-color LED with a mobile device to change the lighting colors and patterns of the removable multi-color LED.

In a method described herein, a golf training aid may be manufactured by providing a golf driver head casing that comprises a recessed cavity accessible from a top of the golf driver head casing, wherein the recessed cavity has a base that is distal from a lower wall of the golf driver head casing. A removable multi-color LED may be positioned within the recessed cavity and may be configured to emit a plurality of lighting patterns. A switch may be coupled electrically and physically to the removable multi-color LED. A rechargeable power source may be housed within the golf driver head. A cover place may be coupled to the face of the golf driver head casing.

A transceiver may be positioned within the recessed cavity of the golf driver head. A first end of a golf driver shaft may be coupled to the golf driver head with a cylindrical internal shaft housing. A grip may be coupled to a second end of the golf driver shaft. A switch may be coupled electrically and physically to the removable multi-color LED. The switch may be positioned distal from an inner wall of the cavity. The switch may be configured to enable a user to select from a variety of colors and flash patterns of the removable multi-color LED.

Aspects and applications of the invention presented here are described below in the drawings and detailed description of the invention. Unless specifically noted, it is intended that the words and phrases in the specification and the claims be given their plain, ordinary, and accustomed meaning to those of ordinary skill in the applicable arts. The inventor is fully aware that he can be his own lexicographer if desired. The inventor expressly elects, as his own lexicographer, to use only the plain and ordinary meaning of terms in the specification and claims unless he clearly states otherwise and then further, expressly sets forth the "special" definition of that term and explains how it differs from the plain and ordinary meaning. Absent such clear statements of intent to apply a "special" definition, it is the inventor's intent and desire that the simple, plain and ordinary meaning to the terms be applied to the interpretation of the specification and claims.

The inventor is also aware of the normal precepts of English grammar. Thus, if a noun, term, or phrase is intended to be further characterized, specified, or narrowed in some way, then such noun, term, or phrase will expressly include additional adjectives, descriptive terms, or other modifiers in accordance with the normal precepts of English grammar. Absent the use of such adjectives, descriptive terms, or modifiers, it is the intent that such nouns, terms, or phrases be given their plain, and ordinary English meaning to those skilled in the applicable arts as set forth above.

Further, the inventor is fully informed of the standards and application of the special provisions of 35 U.S.C. § 112 (f). Thus, the use of the words "function," "means" or "step" in the Detailed Description or Description of the Drawings or Claims is not intended to somehow indicate a desire to invoke the special provisions of 35 U.S.C. § 112 (f), to define the invention. To the contrary, if the provisions of 35 U.S.C. § 112 (f) are sought to be invoked to define the inventions, the claims will specifically and expressly state the exact phrases "means for" or "step for, and will also recite the word "function" (i.e., will state "means for performing the function of [insert function]"), without also reciting in such phrases any structure, material or act in support of the function. Thus, even when the claims recite a "means for performing the function of . . . " or "step for performing the function of . . . ," if the claims also recite any structure, material or acts in support of that means or step, or that perform the recited function, then it is the clear intention of the inventor not to invoke the provisions of 35 U.S.C. § 112 (f). Moreover, even if the provisions of 35 U.S.C. § 112 (f) are invoked to define the claimed inventions, it is intended that the inventions not be limited only to the specific structure, material or acts that are described in the preferred embodiments, but in addition, include any and all structures, materials or acts that perform the claimed function as described in alternative embodiments or forms of the invention, or that are well known present or later-developed, equivalent structures, material or acts for performing the claimed function.

The foregoing and other aspects, features, and advantages will be apparent to those artisans of ordinary skill in the art from the DETAILED DESCRIPTION, DRAWINGS, and CLAIMS.

BRIEF DESCRIPTION OF THE SEVERAL VIEWS OF THE DRAWINGS

A more complete understanding of the present invention may be derived by referring to the detailed description when considered in connection with the following illustrative figures. In the figures, like reference numbers refer to like elements or acts throughout the figures.

Elements and acts in the figures are illustrated for simplicity and have not necessarily been rendered according to any particular sequence or embodiment.

DETAILED DESCRIPTION

In the following description, and for the purposes of explanation, numerous specific details are set forth in order to provide a thorough understanding of the various aspects of the invention. It will be understood, however, by those skilled in the relevant arts, that the present invention may be practiced without these specific details. In other instances, known structures and devices are shown or discussed more generally in order to avoid obscuring the invention. In many cases, a description of the operation is sufficient to enable one to implement the various forms of the invention, particularly when the operation is to be implemented in software. It should be noted that there are many different and alternative configurations, devices and technologies to which the disclosed inventions may be applied. The full scope of the inventions is not limited to the examples that are described below.

Figure 1:
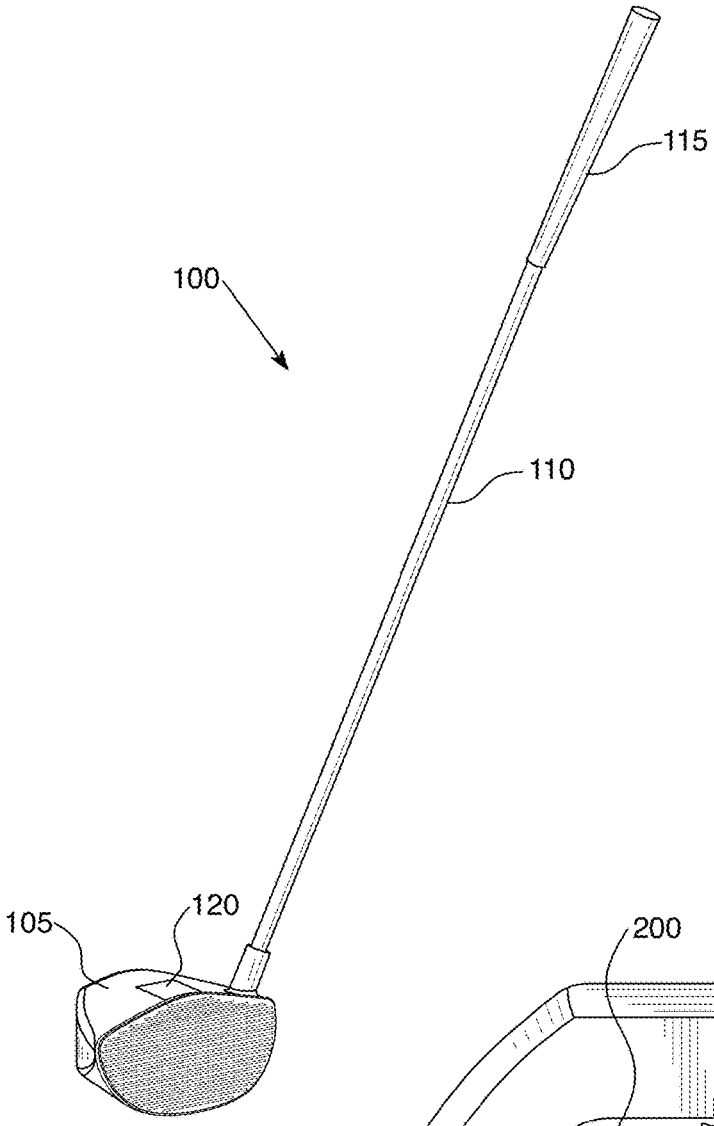
FIG. 1 depicts a front perspective view of an embodiment of a golf training aid.

In one application, as shown in FIG. 1, a golf training aid 100 may comprise a golf driver 101, which may comprise a removable multi-color light-emitting diode (LED) 200 embedded within a golf driver head 105, thus allowing the user to maintain the user's posture and head position while swinging the golf driver 101 by maintaining eye contact with the LED 200, viewing said LED 200 through an opening 120, until a point of contact between the golf driver head 105 and a golf ball (not shown). In one embodiment, the golf training aid 100 comprises a golf club shaft 110 and golf driver grip 115. Alternatively, the golf training aid 100 may only comprise the golf driver head 105 and its internal, constituent parts. In such implementations, the user may couple the golf driver head 105 to a golf club shaft 110 of the user's choosing which may allow a single golf driver head 105 to be used by multiple users of varying heights to accommodate a variety of golf club shaft 110 lengths. In one embodiment, the golf training aid 100 may be comprised of one or more metallic materials or alloys. In other embodiments, the golf training aid 100 may be comprised of one or more plastics, such as by non-limiting example, a polymer or synthetic resin. In yet another embodiment, the golf training aid 100 may comprise one or more ceramic-crystalline structures. In yet another embodiment, the golf training aid 100 may be comprised of one or more woods. In yet another embodiment, the golf training aid 100 may be comprised of any combination of the above listed materials.

Figure 2:
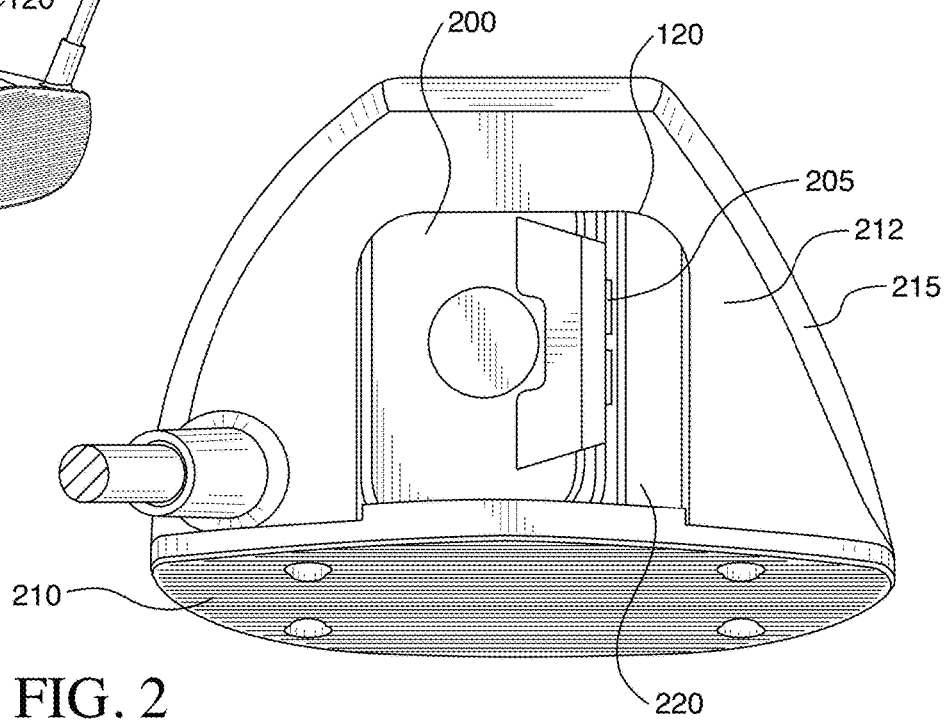
FIG. 2 depicts an overhead view of an implementation of a golf driver head comprising a removable multi-color light-emitting diode (LED) within a recessed cavity of the golf driver head.

As shown in FIG. 2, some implementations of a golf training aid 100 may comprise a golf driver head 105 comprising a golf driver head casing 215 which may comprise an opening 120 on a top 212 of the golf driver head casing 215. The opening 120 may allow the user access to and an unobstructed view of the removable multi-color LED 200 that is positioned in a recessed cavity 220 within the golf driver head 105 during the process of swinging the golf driver 100. In some embodiments, the opening 120 allows the user to manually select a desired light color or flash pattern from among a plurality of possible LED colors and flash patterns by activating a switch 205 located on or within the recessed cavity 220 and proximal to the removable multi-color LED 200.

Figure 3:
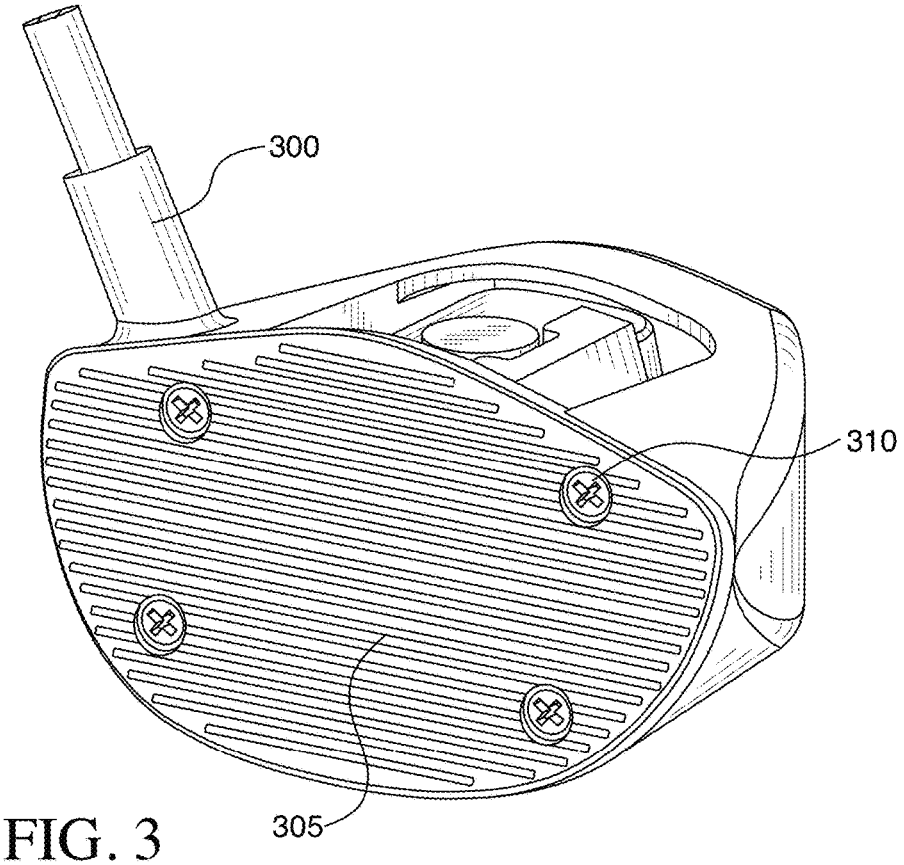
FIG. 3 depicts a front perspective view of the golf driver head.
Figure 5:
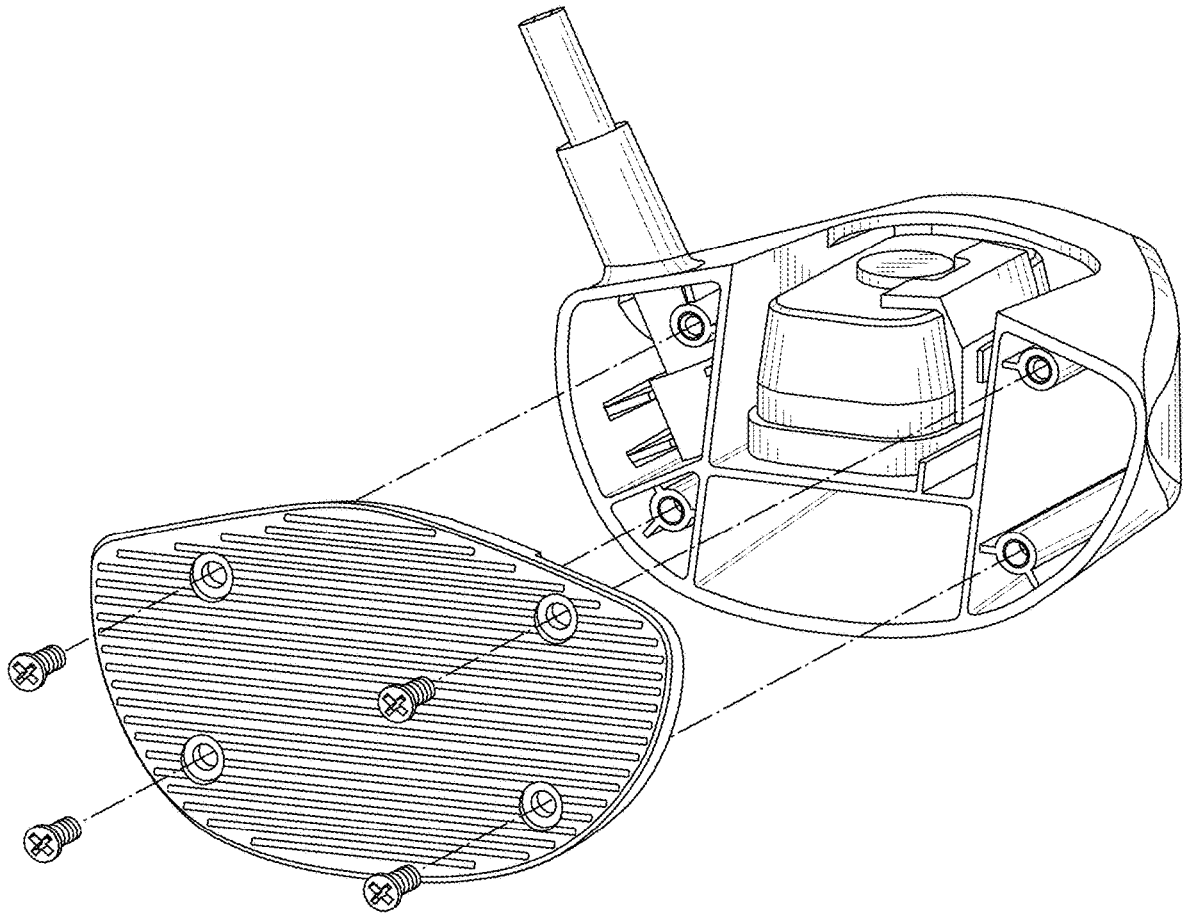
FIG. 5 depicts an exploded view of the golf driver head.

As shown in FIGS. 3 and 5, in some implementations, a cover plate 210 may be coupled to the golf driver head casing 215 to form a face 305 intended to provide contact with a golf ball. While it is contemplated that any appropriate number or type of fastener may be used to couple the cover plate 210 to the golf driver head casing 215, in some implementations, such fasteners may comprise one or more screws, pins, or rivets. In some implementations, the cover plate 210 may be coupled to the golf driver head casing 215 via an adhesive, a weld, a friction fit, or one or more locking tabs. In some embodiments, the cover plate 210 and/or the golf driver head casing 215 may be comprised of one or more metals, alloys, polymers, plastics, resins, ceramic crystalline structures, wood, or a combination thereof. Additionally, in one embodiment, the golf driver shaft 110 enters into the golf driver head 105 via an external receiving member 300.

Figure 4:
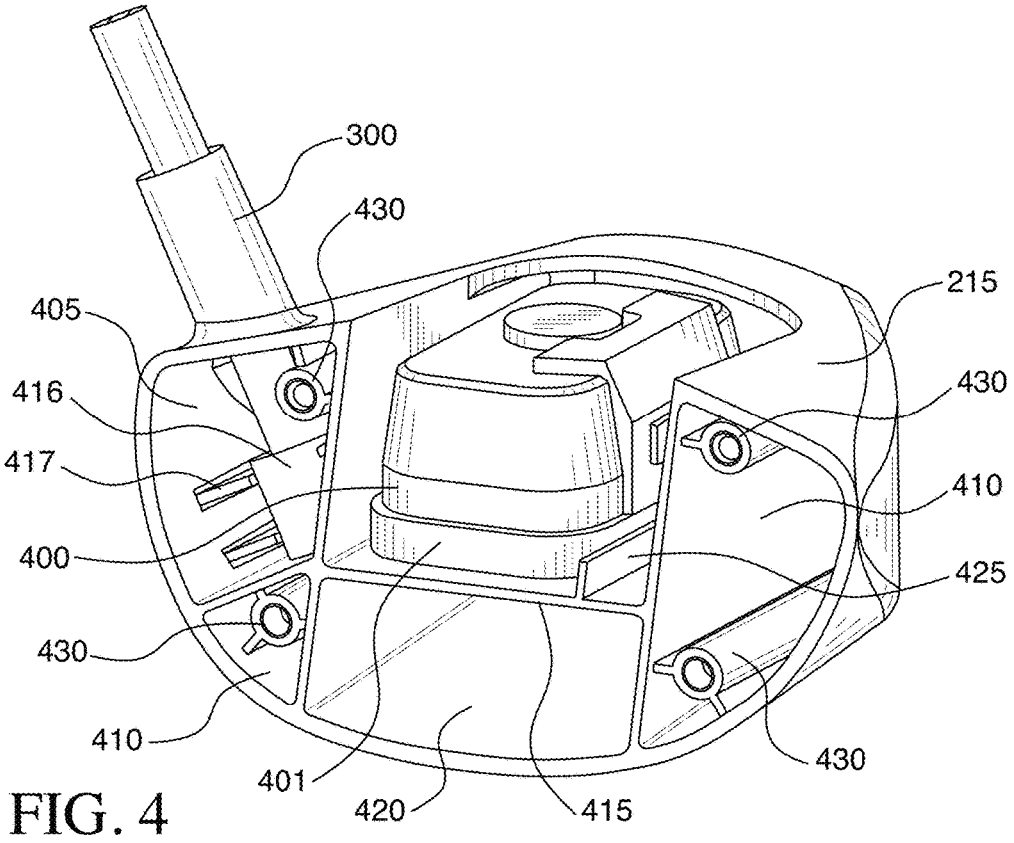
FIG. 4 depicts a cross-sectional view of the golf driver head.

As shown in FIG. 4, in some implementations, the golf driver head casing 215 may comprise one or more chambers 405, 410, 420, 220. The one or more chambers may house certain interior structural components of the golf driver head 105. In one embodiment, the chamber 405 proximal to the golf driver shaft 110 may contain a substantially cylindrical internal shaft housing 416 configured to receive a golf driver shaft 110 therein. The substantially cylindrical internal shaft housing 416 may be comprised of one or more of the following materials: one or more metals, alloys, polymers, plastics, resins, ceramic crystalline structures, wood, or a combination thereof. One or more securing members 417 may affix the substantially cylindrical internal shaft housing 416 to the interior walls of the golf driver head casing 215. One or more fasteners, such as by non-limiting example, screws, pins, or rivets may secure the cover plate 210 through one or more screw receptacles 430. In some embodiment, one or more rails 425 may form a track into which the removable multi-color LED 200 may slide along the base 415. The one or more rails 425 may also help to hold the removable multi-color LED 200 in place on the base 415 of the recessed cavity 220 of the golf driver head 105. In some embodiments, a shock-absorbing material such as by non-limiting example, foam or rubber, may be positioned within the track to prevent the removable multi-color LED 200 from moving when a user swings the golf training aid 100 or when the golf driver head 105 strikes a golf ball.

In other embodiments, the chamber 405 proximal to the golf driver shaft 110 may alternatively achieve the same structural security and shock absorption capability by including additional insulating material or by making the chamber 405 solid rather than hollow. In other embodiments, chambers 410, 420 may similarly be filled with additional insulating material or made solid rather than hollow. In other embodiments, screw receptacles may be unnecessary where the cover plate 210 is secured to the golf driver head casing 215 via an adhesive, a weld, a friction fit, or one or more locking tabs.

A user may use the golf training aid 100 by first selecting a desired color and/or lighting pattern emitted from the removable multi-color light-emitting diode (LED) 200 positioned within the recessed cavity 220 in the golf driver head 105. The user may subsequently position the golf training aid 100 behind a golf ball (not pictured). The user may then swing the golf training aid while maintaining eye contact with the removable multi-color LED 200, viewing the removable multi-color LED 200 through the top of the recessed cavity 220, until the golf driver head 105 contacts the golf ball. The removable multi-color LED 200 may be positioned below the opening 120, within the recessed cavity 220, so as to limit the persistence of vision effect that may otherwise occur due to the fast-moving nature of the golf training aid 100. This may better allow the user to focus on the removable multi-color LED 200 and not on a potential afterimage that may manifest behind the golf training aid 100. By continuing to maintain eye contact with the removable multi-color LED 200 until the point of contact with the golf ball, the user maintains a downward head position that assists the user in striking the golf ball squarely with the golf driver face 305. In one embodiment, the user may configure the removable multi-color LED 200 to emit a desired light color or flash pattern from a plurality of light colors and patterns by activating a switch 205. In another embodiment, the user may select a desired light color or flash pattern from a plurality of lights by using an application coupled with a transceiver 401 housed within the embedded cavity of the golf driver head 105.

FIG. 5 is an exploded view of the golf driver head 105. In some embodiments, a user may remove the removable multi-color light-emitting diode (LED) 200 by first removing one or more screws 310, separating the cover plate 210 from the golf driver head casing 215, and sliding the removable multi-color LED 200 from a track 425 in order to recharge it. In other embodiments, the user may be able to charge the removable multi-color LED 200 while it is still embedded within the recessed cavity 220 of the golf driver head 105. In other embodiments, in order to recharge the removable multi-color LED 200, the user may be able to remove it via the opening 120 on the top 212 of the golf driver head 105.

In another embodiment, the user may control the removable multi-color light-emitting diode (LED) 200 via a transceiver 401 configured to transmit and receive a wireless communication signal to and from a mobile device. The transceiver 401 may be positioned in a plurality of locations in the golf driver head 105. In some embodiments, the switch 205 may remain in its current position and with its current functionality in addition to the transceiver 401 so as to give the user both wireless and physical options to change the light color and flash pattern of the LED 200. In other embodiments, the transceiver 401 may replace the switch 205. In another embodiment, the user may utilize a conventional computing and communications platform, such as a cellular or mobile smart phone, tablet, laptop, or desktop computer, running a software application, to control emitted light color and flash pattern of the removable multi-color LED 200.

In places where the description above refers to particular implementations of systems and methods for golf training aid for proper head positioning throughout the user's swing, it should be readily apparent that a number of modifications may be made without departing from the spirit thereof and that these implementations may be applied to other to systems and methods for golf training aid for proper head positioning throughout the user's swing.

I claim:

1. A golf driver head, comprising: an interior comprising a recessed cavity therein, the recessed cavity being accessible from a top of the golf driver head; a removable multi-color light-emitting diode (LED) positioned below an opening of the recessed cavity, the removable multi-color LED configured to emit a plurality of consistent lighting patterns configured to be maintained throughout a swing, while a user views the removable multi-color LED through an opening of the recessed cavity thereby facilitating a downward head position of the user until contact with a ball; a user-actuated switch integrated within the golf driver head and electrically connected to the removable multi-color LED and configured to change at least one of a color and a flash pattern of the removable multi-color LED; a rechargeable power source housed within the golf driver head and coupled to the removable multi-color LED; a mobile device and a transceiver configured to transmit and receive a wireless communication signal to and from the mobile device; a switch integrated within a recessed cavity of the head of the golf driver, the switch electrically connected to the removable multi-color LED and configured to change at least one of a light color and a light flash pattern of the removable multi-color LED; and transmitting, by a mobile device, a wireless communication signal to a transceiver that is in communication with the removable multi-color LED; and effectuating a change in at least one of a light color and a light flash pattern emitted by the removable multi-color LED in response to the wireless communication signal received by the transceiver.

2. The golf driver head of claim 1, further comprising a substantially cylindrical internal shaft housing configured to receive a golf driver shaft therein.

3. The golf driver head of claim 1, further comprising a cover plate coupled to a face of the golf driver head.

4. The golf driver head of claim 1, wherein the recessed cavity comprises a base that is distal from a lower wall of the golf driver head.

5. The golf driver head of claim 4, wherein a hollow chamber is formed between the base of the recessed cavity and the lower wall of the golf driver head.

6. The golf driver head of claim 4, further comprising a switch physically and electrically attached to the removable multi-color LED.

7. The golf driver head of claim 6, wherein the switch includes light color and flash pattern configuration options.

8. The golf driver head of claim 6, further comprising distal separation between the switch and an inner wall of a recessed cavity.

9. The golf driver head of claim 6, wherein the switch partially covers a top of the removable multi-color LED.

10. A method of golf training, comprising: selecting, by a user, a desired color emitted from a removable multi-color light-emitting diode (LED) positioned below an opening of a recessed cavity in a head of a golf driver, the removable multi-color LED configured to emit a plurality of consistent lighting patterns configured to be maintained throughout a swing; aligning, by the user, the golf driver behind a golf ball; and swinging, by the user, the golf driver while continually viewing the removable multi-color LED through the opening of the recessed cavity thereby facilitating a downward head position of the user until the head of the golf driver contacts the golf ball; actuating, by the user, a switch integrated within a recessed cavity of the head of the golf driver, the switch electrically connected to the removable multi-color LED and configured to change at least one of a light color and a light flash pattern of the removable multi-color LED; transmitting, by a mobile device, a wireless communication signal to a transceiver that is in communication with the removable multi-color LED; and effectuating a change in at least one of a light color and a light flash pattern emitted by the removable multi-color LED in response to the wireless communication signal received by the transceiver.

* * * * *